United States Patent [19]

Seki

[11] 4,217,685

[45] Aug. 19, 1980

[54] METHOD OF AND APPARATUS FOR ATTACHING TOP STOPS TO A SLIDE FASTENER CHAIN

[75] Inventor: Fumio Seki, Toyama, Japan

[73] Assignee: Yoshida Kogyo K. K., Tokyo, Japan

[21] Appl. No.: 962,177

[22] Filed: Nov. 20, 1978

[30] Foreign Application Priority Data

Nov. 25, 1977 [JP] Japan ..... 52-141169

[51] Int. Cl.[2] ..... B23P 19/04

[52] U.S. Cl. ..... 29/408; 29/767

[58] Field of Search ..... 29/766, 767, 408, 33.2

[56] References Cited

U.S. PATENT DOCUMENTS

| | | | |
|---|---|---|---|
| 2,096,685 | 10/1937 | Osgood | 29/767 |
| 3,541,662 | 11/1970 | Perlman | 29/767 |
| 3,689,980 | 9/1972 | Oyama | 29/767 |
| 3,863,321 | 2/1975 | Perlman | 29/767 |

FOREIGN PATENT DOCUMENTS

| | | | |
|---|---|---|---|
| 3923779 | 10/1964 | Japan | 29/767 |

*Primary Examiner*—Lowell A. Larson

*Attorney, Agent, or Firm*—Hill, Van Santen, Steadman, Chiara & Simpson

[57] ABSTRACT

A fastener chain being fed along a predetermined path is brought to a temporary standstill each time an actuating pawl, engaged by one of the successive spaced pairs of interengaged scoop groups of the fastener chain, is displaced a predetermined distance therewith to actuate a limit switch. A separator mechanism responds to the actuation of the limit switch to spread one of the successive pairs of opposed blank tape spaces of the fastener chain to an extent necessary to partly disengage the preceding or succeeding pair of scoop groups. The fastener chain is then moved along the path, either rearwardly or forwardly, to such an extent that the disengaged endmost scoops of the partly disengaged pair of scoop groups come into abutment against a stop disposed adjacent to a die. A punch mechanism coacts with the die to apply a pair of top stops to the endmost scoops. The above cycle of operation is repeated to attach top stops to the trailing or leading ends of the successive pairs of scoop groups.

16 Claims, 17 Drawing Figures

METHOD OF AND APPARATUS FOR ATTACHING TOP STOPS TO A SLIDE FASTENER CHAIN

BACKGROUND OF THE INVENTION

1. Field of the Invention

This invention relates to the production or assemblage of slide fasteners, and in particular to the attachment to a fastener chain (i.e., a continuous length of a pair of coupled stringers) of top stops which arrest the movement of a slider in its uppermost or closed position in a completed slide fastener.

2. Description of the Prior Art

A variety of methods and apparatus have been suggested and employed for the application of top stops to the endmost scoops of the successive spaced pairs of opposed scoop groups, or to the ends of the blank tape spaces adjoining the endmost scoops, of a fastener chain. According to the majority of such known methods and apparatus, the fastener chain is fed along a predetermined path, and its movement is periodically arrested by some stop means movable into engagement therewith, for bringing the successive endmost scoops or the adjoining ends of the blank tape spaces to a location where top stops are applied. This conventional practice is objectionable because the positions of the endmost scoops or of the adjoining tape space ends for the application of top stops are determined by the movable stop means and, consequently, because the top stops do not necessarily become attached to the exact desired points on the fastener chain.

SUMMARY OF THE INVENTION

It is an object of this invention to provide an improved method of continuously or consecutively attaching top stops to a slide fastener chain precisely in desired positions thereon.

It is also an object of this invention to provide an apparatus well calculated to carry out the above method to the best advantage.

Stated in brief, the method of this invention comprises the steps of feeding a fastener chain longitudinally along a predetermined path; causing a displaceable actuating pawl to be engaged by one of the successive spaced pairs of interengaged groups of scoops of the fastener chain so as to be displaced therewith along the path; causing a separator to spread a pair of opposed blank tape spaces of the fastener chain in response to a signal generated upon displacement of the actuating pawl over a predetermined distance with the fastener chain, the pair of blank tape spaces being spread to such an extent that at least one adjacent pair of scoop groups are partly disengaged from each other; further moving the fastener chain along the path until the disengaged endmost scoops of the partly disengaged pair of scoop groups move into abutment against stop means immovably disposed adjacent to a die, thereby positioning the disengaged end portions of the partly disengaged pair of scoop groups upon the die; and attaching top stops to the disengaged end portions of the partly disengaged pair of scoop groups by punch means coacting with the die. The foregoing steps are repeated to apply top stops to the desired end portions of the successive spaced pairs of scoop groups.

In the practice of the above method, the fastener chain is preferably brought to a temporary standstill each time the actuating pawl is displaced the predetermined distance therewith. The pair of opposed blank tape spaces may then be spread in such a manner to cause partial disengagement of the preceding or succeeding pair of scoop groups. The fastener chain may then be moved rearwardly in case the preceding pair of scoop groups have been partly disengaged, and forwardly in case the succeeding pair of scoop groups have been partly disengaged, along the path until the disengaged endmost scoops move into abutment against the stop means. In this manner, top stops can be attached to either the trailing or leading end portions of the successive spaced pairs of scoop groups.

Thus, according to the method of this invention summarized in the foregoing, the operation of attaching a pair of top stops to the trailing or leading end portions of each pair of scoop groups is initiated positively and precisely as the actuating pawl is displaced the predetermined distance in engagement with one of the successive pairs of interengaged scoop groups. Moreover, the positions of the desired end portions of each pair of scoop groups upon the die are determined directly by the stationary stop means against which the disengaged endmost scoops are moved into abutment, so that the top stops can be attached to the fastener chain exactly in desired positions thereon.

The apparatus for the practice of the above method includes means for feeding the fastener chain along the predetermined path. The actuating pawl is disposed on the median line of the fastener chain for movement both along the path and in a plane normal to the plane of the fastener chain. Biased by spring or like means, the actuating pawl is capable of passing between each pair of opposed blank tape spaces of the fastener chain so as to be engaged by the succeeding pair of interengaged scoop groups. Switch means is actuated by the actuating pawl upon displacement of the latter with the fastener chain over the predetermined distance. Separator means responds to the actuation of the switch means to spread the pair of blank tape spaces to an extent necessary for partial disengagement of at least one adjacent pair of scoop groups. The die is disposed on the path of the fastener chain, and the noted stop means is immovably disposed adjacent to the die for engaging and stopping the disengaged endmost scoops of the partly disengaged pair of scoop groups as the fastener chain is moved along the path following the operation of the separator means. Top stops are applied by punch means of suitable design coacting with the die.

Preferably, the separator means includes a finger which has a pair of separable halves and which is capable of projecting through the gap between each pair of opposed blank tape spaces for spreading them apart, in such a way that the preceding or succeeding pair of scoop groups are disengaged only a limited distance necessary for the application of top stops. Another advantage of this apparatus is that both die and stop means are so disposed that the disengaged end portions of the partly disengaged pair of scoop groups can be positioned upon the die simply as the fastener chain is moved along the predetermined path until the disengaged endmost scoops come into abutment against the stop means. These advantages, combined with the above noted advantages of the inventive method itself, enable the apparatus to efficiently apply top stops to the fastener chain exactly in desired positions thereon, through a streamlined procedure which is easy to automate.

The above and other objects, features and advantages of this invention and the manner of attaining them will become more readily apparent, and the invention itself will best be understood, from the following description taken in connection with the accompanying drawings.

DETAILED DESCRIPTION

Figure 1:
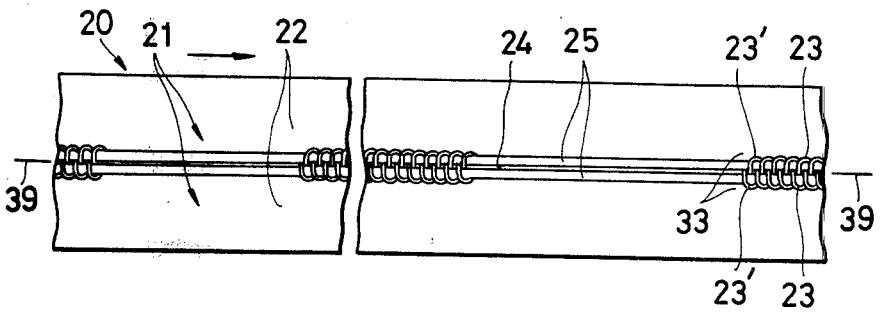
FIG. 1 is a fragmentary plan view of a slide fastener chain to which top stops are to be attached in accordance with this invention.

As shown in FIG. 1, a slide fastener chain 20 to which top stops are to be applied by the method and apparatus of this invention is in the form of a pair of coupled continuous stringers 21. Each stringer 21 includes a continuous tape 22 on which there are mounted successive spaced groups of scoops or fastener elements 23 along one longitudinal edge in mating interengagement with the opposed complementary groups of scoops on the other stringer tape. Blank tape spaces 24 are left between the interengaged groups of scoops 23. Purely by way of example, each group of scoops 23 are shown to be formed by the undulations or turns of a continuous coupling element of the known helicoidal coil type. These continuous coupling elements are secured to the stringer tapes 22, with the aid of continuous core cords 25 passing through the coupling elements.

In this specification and in the appended claims the terms "preceding" and "succeeding", and "leading" and "trailing", are used with reference to a predetermined direction in which the fastener chain 20 is fed for the application of top stops thereto. Thus, if the fastener chain 20 is to be fed in the direction indicated by the arrow in FIG. 1, for example, then the pair of interengaged groups of scoops designated 23 in this figure precedes the pair of opposed blank tape spaces 24. The scoops at the trailing end of this pair of scoop groups are designated 23'.

Figure 2:
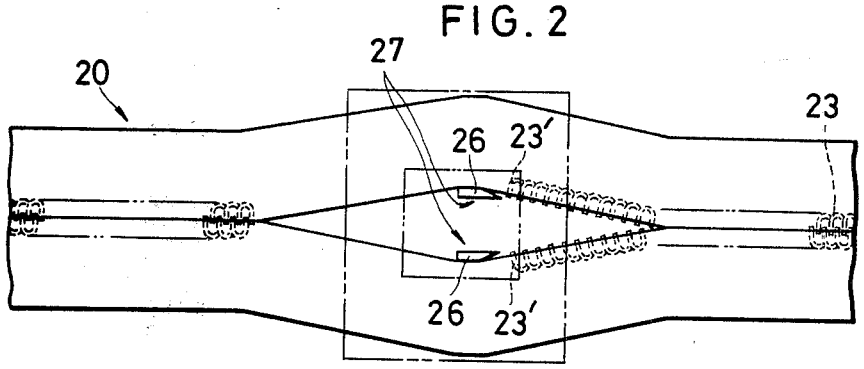
FIG. 2 is a plan view of explanatory nature showing the fastener chain of FIG. 1 with its pair of constituent stringers partly separated for the attachment of top stops in accordance with the invention.

According to one aspect of the invention, each pair of opposed blank tape spaces 24 of the fastener chain 20 are spread by the separable halves 26 of a separator finger 27, as shown in FIG. 2, thereby partly disengaging the preceding pair of scoop groups 23. Top stops are attached to the scoops 23' at the trailing end of the partly disengaged pair of scoop groups.

Figure 3B:
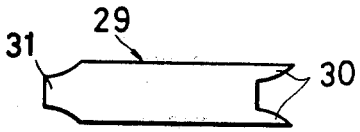
FIG. 3B is a plan view of one of the top stop blanks severed from the strip of FIG. 3A.
Figure 3A:
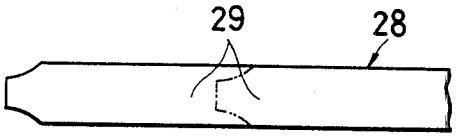
FIG. 3A is a plan view of a strip of material to be severed into the blanks of top stops suitable for use in the practice of the invention.
Figure 3C:
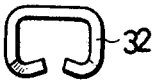
FIG. 3C is a side elevational view of a top stop formed from the blank of FIG. 3B.

FIGS. 3A, 3B and 3C are illustrations of an example of top stops suitable for use with the invention. The illustrated top stops are formed by cutting an elongated strip 28 of suitable material such as metal into blanks 29. Each top stop blank 29 has a pair of laterally spaced, pointed legs 30 at one end and a blunt-ended leg 31 at the other end. For use as a top stop 32, the blank 29 is bent and clinched as shown in FIG. 3C.

Figure 4:
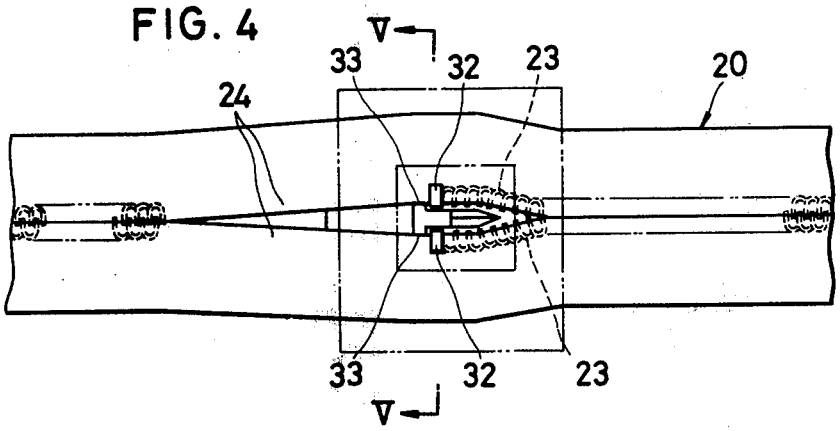
FIG. 4 is a plan view schematically illustrating the fastener chain of FIG. 1 with a pair of the top stops attached thereto.
Figure 5:
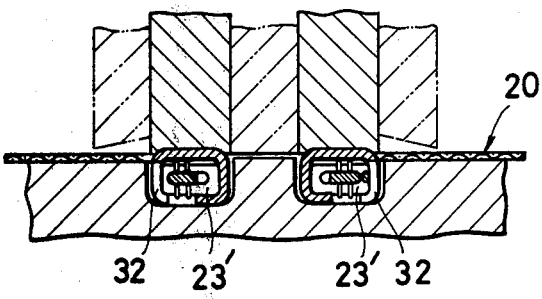
FIG. 5 is an enlarged sectional view taken along the line V—V of FIG. 4.
Figure 6:
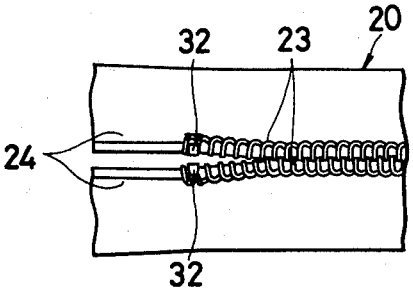
FIG. 6 is a fragmentary plan view showing the fastener chain of FIG. 1 together with the pair of top stops attached thereto.

In FIGS. 4, 5 and 6 are shown a pair of the top stops 32 attached to the trailing ends of the partly disengaged pair of scoop groups 23 in accordance with the method and apparatus of this invention. Although each top stop 32 is shown to embrace only the endmost scoop 23' of one of the scoop groups, the top stop may be adapted to embrace two or more consecutive scoops within the scope of the invention. Further, if desired, the top stops may be applied to the leading end portions 33 of the blank tape spaces 24.

The apparatus of this invention is hereinafter described in detail with particular reference to FIG. 7. The method of the invention is set forth after the description of the apparatus.

Figure 7:
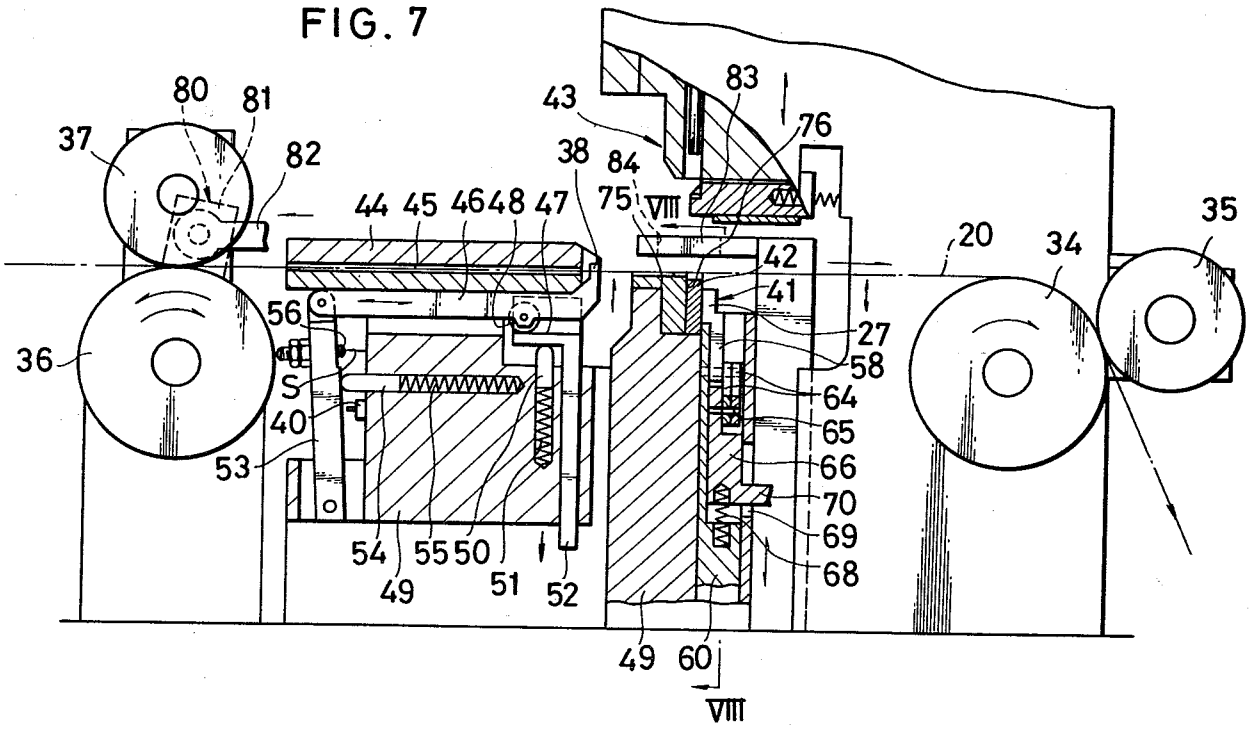
FIG. 7 is a side elevational view, partly sectioned for clarity, of a preferred form of the apparatus in accordance with the invention.

The apparatus of FIG. 7 broadly comprises a pair of feed rolls 34 and 35 coacting with a pair of squeeze rolls 36 and 37 to define a horizontal path along which the fastener chain 20 is fed with its groups of scoops 23 directed downwardly, a displaceable actuating pawl 38 disposed on the median line 39 (FIG. 1) of the fastener chain traveling along the path, a limit switch 40 to be actuated upon displacement of the actuating pawl, a separator mechanism 41 including the separator finger 27 which responds to the actuation of the limit switch to spread a pair of the blank tape spaces 24 of the fastener chain to such an extent that the preceding pair of scoop groups 23 are partly disengaged from each other, a die 42 for receiving the disengaged endmost scoops of the partly disengaged pair of scoop groups, and a punch mechanism 43 movable up and down to apply the top stops 32 to the disengaged endmost scoops on the die.

Like the above defined terms "preceding" and "succeeding", and "leading" and "trailing", the terms "forward" and "rearward" are also used herein and in the claims appended hereto with reference to the predetermined direction (rightward as viewed in FIG. 7) in which the fastener chain 20 is fed along the predetermined path. Thus, in FIG. 7, the actuating pawl 38 is disposed rearwardly of the die 42, and the separator mechanism 41 is disposed forwardly of the die.

The feed roll 34 is a drive roll connected through an electromagnetic clutch to a suitable drive mechanism (not shown). Further, in this particular embodiment of the invention, the squeeze roll 36 serves the additional purpose of moving the fastener chain 20 a limited distance in the reverse direction as described below.

A guide block 44 disposed forwardly of the pair of squeeze rolls 36 and 37 defines therein a guideway 45 for the fastener chain 20 so that the latter may travel along the predetermined path without transverse displacement. Further disposed forwardly of the guide block 44 is the actuating pawl 38 which lies on the median line 39 of the fastener chain 20 emerging from the guide block 44. The actuating pawl 38 is formed at and angled upwardly from the right hand end, as viewed in FIG. 7, of a first arm 46 extending horizontally under the guide block 44. The first arm 46 together with the actuating pawl 38 is supported by the following means so as to be both movable along the fastener chain path and pivotable about its left hand end in a vertical plane.

The right hand end of the first arm 46 rests by gravity on a horizontally disposed arm support 47 via a roller 48 rotatably mounted on the first arm. The first arm 46 can therefore roll over the arm support 47 for its movement along the fastener chain path. Slidably supported by the frame 49 of the apparatus for up and down motion relative to same, is a plunger 50 that is biased upwardly by a helical compression spring 51 into abutting engagement with the arm support 47. The arm support 47 is formed at the top end of an upstanding bar 52 which is also slidably supported by the frame 50 for up and down motion relative to same. The bar 52 is connected to an actuating mechanism (not shown) of any known or suitable design capable of moving the bar, and therefore the arm support 47, downwardly against the bias of the compression spring 51.

Normally, the non-illustrated actuating mechanism is held inoperative so that the right hand end of the first arm 46 is urged upwardly under the bias of the compression spring 51. The actuating pawl 38 is thus spring energized to pass upwardly between each pair of opposed blank tape spaces 24 of the fastener chain 20 emerging from the guideway 45, to be engaged by the succeeding pair of interengaged scoop groups 23.

The first arm 46 has its left hand end pivotally connected to the top end of an upstanding second arm 53. The second arm is pivotally mounted at its bottom end on the frame 49. The first arm 46 is thus permitted both to pivot about its left hand end in the vertical plane containing the median line 39 of the fastener chain 20 and to move in the same plane along the fastener chain path in rolling engagement with the arm support 47.

A plunger 54 slidably supported by the frame 49 is biased by a helical compression spring 55 into abutting engagement with the second arm 53, thereby urging the latter leftwardly or rearwardly with respect to the predetermined traveling direction of the fastener chain 20 along the path. The limit switch 40 is mounted on the frame 49 in opposed relationship to the second arm 53. This second arm is therefore to be pivoted in a clockwise direction against the bias of the compression spring 55 when the actuating pawl 38, engaged by each pair of interengaged scoop groups 23 of the fastener chain 20, is displaced therewith forwardly along the path.

The limit switch 40 is actuated by the second arm 53 each time the actuating pawl 38 is displaced a predetermined distance along the fastener chain path in engagement with one of the successive spaced pairs of interengaged scoop groups 23. The actuation of the limit switch 40 results in the temporary termination of the fastener chain movement along the path, among other operations hereinafter set forth. The stroke S of the second arm 53 can be adjustably varied by an adjusting bolt 56 carried thereon.

For spreading a pair of opposed blank tape spaces 24 of the temporarily stopped fastener chain 20, the separator mechanism 41 is disposed under the fastener chain path and some distance forwardly of the actuating pawl 38. As pictured also in FIGS. 8 and 9, the separator mechanism 41 includes the separator finger 27 which is aligned with the median line 39 of the fastener chain 20 and which is tapered both upwardly and forwardly. As mentioned, the separator finger 27 has the pair of halves 26 which are movable toward and away from each other in a direction transverse to the fastener chain 20, besides being jointly movable up and down relative to the fastener chain.

The separable halves 26 of the separator finger 27 are each formed on one of the arms 57 of a pair of bell cranks 58 which are pivotally pinned at 59 on an upstanding, hollow guide structure 60. The hollow guide structure 60 is slidably supported by the frame 49 for up and down motion relative to same. Connected to a suitable actuating mechanism (not shown), the hollow guide structure 60 is movable at least between a lowered position of FIG. 8 and a raised position of FIG. 10.

The other arms 61 of the bell cranks 58 extend away from each other through openings 62 formed in the confronting side walls of the hollow guide structure 60. The bell crank arms 61 are pivotally pinned at 63 to the ends of a pair of links 64, respectively. The opposite ends of the links 64 are connected by a common pivot pin 65 to a slide 66 slidably received in the hollow 67 of the guide structure 60 and thereby constrained to up and down motion relative to same. A helical compression spring 68 is mounted between the guide structure 60 and the slide 66 to bias the latter upwardly, so that the separator finger halves 26 are normally held in close contact with each other via the bell cranks 58 and links 64.

Projecting forwardly from the slide 66, through an opening 69 in the guide structure 60, is an arm 70 which is operatively connected to a suitable actuating mechanism (not shown) capable of moving the slide up and down relative to the guide structure. The slide 66 is to be lowered against the bias of the compression spring 68 by the non-illustrated actuating mechanism while the separator finger 27 is in the raised position of FIG. 10.

Figure 8:
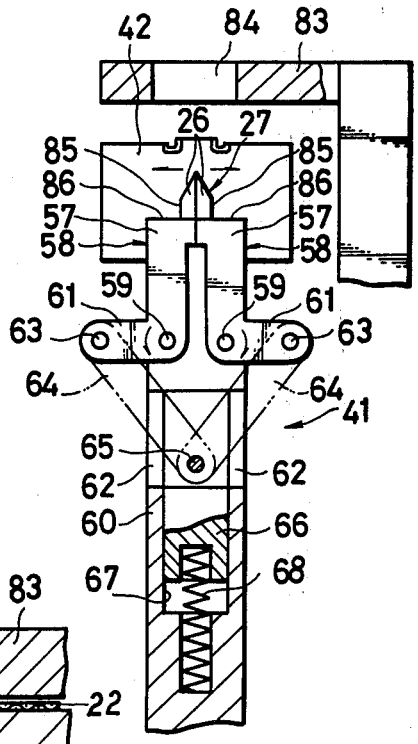
FIG. 8 is an enlarged elevational view, partly sectioned for clarity, of the separator mechanism in the apparatus of FIG. 7, taken along line VIII—VIII in FIG. 7.

The descent of the slide 66 results in the pivotal motion of the pair of bell cranks 58 in the opposite directions indicated by the arrows in FIG. 8. The separator finger halves 26 are thus moved away from each other to spread the pair of opposed blank tape spaces 24 and to partly disengage the preceding pair of scoop groups 23 as shown in FIG. 2.

Figure 9:
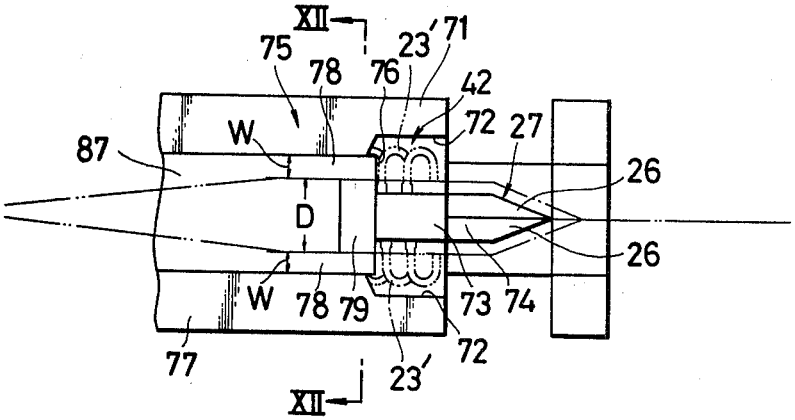
FIG. 9 is an enlarged top plan view of the stop, die, and part of the separator mechanism in the apparatus of FIG. 7, wherein the chain-dot line represents the fastener stringers being separated.

The die 42 is also disposed under the path of the fastener chain 20, just rearwardly of the separator mechanism 41. Formed in the horizontally disposed top surface 71 of the die 42 are a pair of transversely spaced, parallel channel-like cavities 72 for receiving the trailing endmost scoops 23' of the partly disengaged pair of scoop groups 23. The die cavities 72 are so shaped and sized in relation to the scoops 23 that the top stops 32 can be bent and clinched around the endmost scoops 23' therein as shown in FIG. 5. As shown in FIG. 9, the width of the land 73 between the die cavities 72 is equal to the width or thickness of the untapered portion 74 of the separator finger 27 with its separable halves 26 in close contact with each other.

Disposed further rearwardly of the die 42 is a stop 75 having an abutment 76 which lies in a vertical plane transverse to the fastener chain 20 and which substantially bounds the rear extremities of the die cavities 72. This abutment 76 is intended to engage and stop the trailing endmost scoops 23' of the partly disengaged pair of scoop groups 23 as the latter are moved rearwardly past the separator finger 27, with its separable halves 26 closed after having spread the pair of opposed blank tape spaces 24, by the aforementioned reverse rotation of the squeeze roll 36. The endmost scoops 23' are thus properly positioned in the respective die cavities 72.

The stop 75 has a top surface 77 disposed flush with the top surface 71 of the die 42 and substantially on a level with the guideway 45 defined by the guide block 44. Formed in this top surface 77 are a pair of transversely spaced, parallel grooves 78 for relatively closely receiving the continuous core cords 25 of the fastener chain 20.

Figure 12:
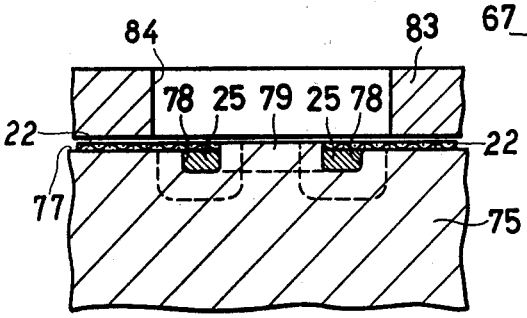
FIG. 12 appearing with FIG. 8, is a sectional view taken along the line XII—XII of FIG. 9 and showing the stop together with the fastener chain thereon.
Figure 11:
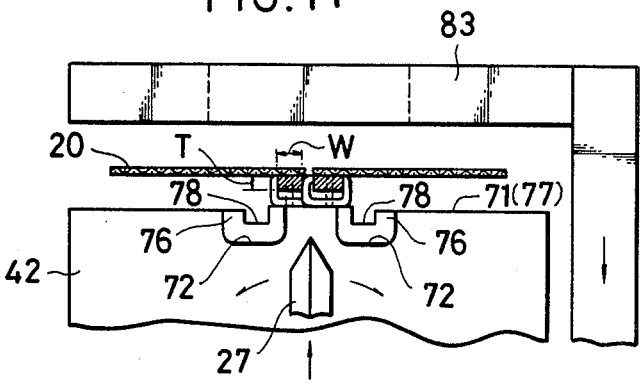
FIG. 11 appearing with FIG. 9, is a view similar to FIG. 10 except that the separator mechanism is shown in the lowered position.

As will be noted from FIGS. 9, 11 and 12, each of the grooves 78 in the stop 75 has a depth and width approximately equal to the thickness T and width W, respectively, of each core cord 25. The grooves 78 are aligned with the die cavities 72. The width D of the land 79 between these grooves, however, is greater than the width of the land 73 between the die cavities 72, to such an extent that those portions of the core cords 25 which immediately succeed the partly disengaged pair of scoop groups 23 are received in the grooves 78 as the endmost scoops 23' of these scoop groups are positioned in the die cavities. The top surface portion of the stop 75, indicated at 87 in FIG. 9, is also formed into a depression of the same depth as the grooves 78.

With reference back to FIG. 7, the squeeze roll 36 is provided with a reverse feed mechanism 80 for feeding the fastener chain 20 rearwardly a limited distance such that the endmost scoops 23' of the partly disengaged pair of scoop groups 23 are moved back into engagement with the abutment 76 of the stop 75. The reverse feed mechanism 80 comprises a generally vertical lever 81 connected at its lower end to the lower squeeze roll 36 via an electromagnetic brake used as a clutch (not shown), and an arm 82 pivotally connected to the other end of the lever 81.

Connected to a suitable actuating mechanism (not shown), the arm 82 can be thrusted leftwardly or rearwardly to cause pivotal motion of the lever 81 in a counterclockwise direction. The pivoting of the lever 81 is transmitted to the squeeze roll 36 via the non-illustrated electromagnetic brake, which is then in engagement. The stroke of the arm 82 corresponds substantially to the distance the fastener chain 20 is required to traverse in moving the disengaged endmost scoops 23' backwardly into engagement with the abutment 76.

A fastener chain holder plate 83 (FIGS. 10, 12) having an opening 84 formed therein is disposed over the die 42 and stop 75 for up and down motion relative to same. When lowered by an actuating mechanism (not shown), the holder plate 83 lightly holds the stringer tapes 22 on the top surfaces 71 and 77 of the die 42 and stop 75. The punch mechanism 43 also disposed over the die 42 for up and down motion relative to same is shown to be of prior art construction.

Although the details of the circuitry for the automatic operation of this apparatus are not specifically illustrated because of their rather common and well known nature, it is to be understood that the actuation of the limit switch 40 results, either simultaneously or successively, in the termination of the fastener chain movement along the path, the descent of the upstanding bar 52 and fastener chain holder plate 83, the ascent of the hollow guide structure 60, the descent of the slide 66, the leftward or rearward thrust of the arm 82, and the descent of the punch mechanism 43. It is further understood that these parts and components of the apparatus are to be returned to their initial positions shown in FIG. 7 after a certain time interval has elapsed.

In the operation of the FIG. 7 apparatus, the fastener chain 20 of FIG. 1 is first threaded, with the successive pairs of interengaged scoop groups 23 directed downwardly, between the pair of squeeze rolls 36 and 37, through the guideway 45 in the guide block 44, over the die 42, and between the pair of feed rolls 34 and 35. The actuating pawl 38 may be held in abutment against one of the pairs of interengaged scoop groups 23 under the bias of the compression spring 51.

The drive roll 34 may now be set in rotation to initiate the travel of the fastener chain 20 forwardly or rightwardly along the path. As one of the pairs of opposed blank tape spaces 24 of the fastener chain 20 emerges from the guideway 45, the actuating pawl 38 projects upwardly through the gap between the pair of blank tape spaces under the bias of the compression spring 51. With the continued travel of the fastener chain 20, the actuating pawl 38 is engaged by the succeeding pair of interengaged scoop groups 23 and is thereby transported forwardly along the path. The upstanding second arm 53 is pivoted in the clockwise direction against the bias of the compression spring 55 with the forward travel of the actuating pawl 38, until the second arm engages and actuates the limit switch 40.

As mentioned, the drive roll 34 is stopped in response to actuation of the limit switch 40. Simultaneously, the upstanding bar 52 is lowered against the bias of the compression spring 51, with the result that the actuating pawl 38 falls by gravity out of engagement with the fastener chain 20, down to the arm support 47. The disengaged actuating pawl 38 is then moved back to the initial position as the second arm 53 is pivoted in the counterclockwise direction under the bias of the compression spring 55.

The hollow guide structure 60 of the separator mechanism 41 is also raised immediately upon actuation of the limit switch 40. When the fastener chain 20 is stopped as described above, the leading end of the pair of blank tape spaces 24 between which the actuating pawl 38 has been caught is located forwardly of the separator finger 27. Thus, upon ascent of the guide structure 60, the separator finger 27 projects upwardly through the gap between this particular pair of blank tape spaces 24.

The fastener chain holder plate 83 is then lowered to lightly hold the pair of stringer tapes 22 against the top surfaces 71 and 77 of the die 42 and stop 75. Then the slide 66 is lowered against the bias of the compression spring 68 within the raised hollow guide structure 60, thereby causing the pair of separator finger halves 26 to move apart from each other. Thus, as shown in FIG. 2, the pair of blank tape spaces 24 are spread to such an extent that the preceding pair of interengaged scoop groups 23 are partly disengaged. The slide 66 is then allowed to move upwardly under the bias of the compression spring 68 relative to the guide structure 60, thereby causing the separator finger halves 26 to move back into contact with each other.

Then, with the electromagnetic brake on the squeeze roll 36 engaged and with the electromagnetic clutch on the drive roll 34 disengaged, the arm 82 of the reverse feed mechanism 80 is thrusted rearwardly to cause the pivotal motion of the lever 81 in the counterclockwise direction, so that the fastener chain 20 is moved rearwardly along the path by the reverse movement of the squeeze roll 36.

Figure 10:
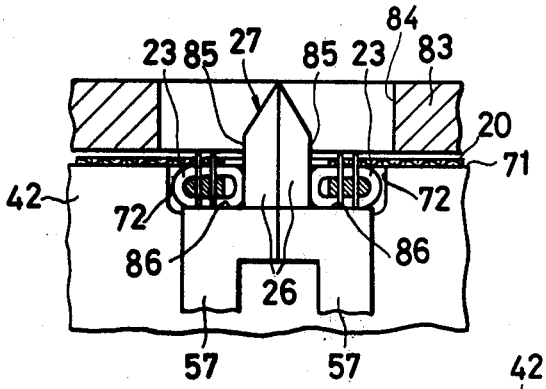
FIG. 10 appearing with FIG. 8, is a partial elevational view, partly in section, showing the separator mechanism in the raised position, the view also showing the die together with the scoops received in its cavities for the application of top stops.

As depicted in FIG. 10, the endmost scoops 23' of the partly disengaged pair of scoop groups 23 travel rearwardly past the separator finger 27, while being guided by its opposite lateral surfaces 85 and the top surfaces 86 of the bell crank arms 57, into the die cavities 72. The rearward travel of the fastener chain 20 terminates as the endmost scoops 23' move into engagement against the abutment 76 of the stop 75. The endmost scoops 23' are now properly positioned in the die cavities 72, and as shown in FIG. 12, those portions of the core cords 25 which immediately succeed these endmost scoops are received in the grooves 78 in the stop 75.

The punch mechanism 43 is then actuated to apply the top stops 32 to the endmost scoops 23' in the die cavities 72, as shown in FIGS. 4, 5 and 6. The punch mechanism 43 and fastener chain holder plate 83 are then raised to their initial positions. Thereafter, preferably, the guide structure 60 of the separator mechanism 41 is again raised to such an extent that the endmost scoops 23' together with the top stops 32 thereon are ejected from the die cavities 72 by the top surfaces 86 of the bell crank arms 57. The guide structure 60 is then lowered to the initial position of FIG. 8. The arm 82 of the reverse feed mechanism 80 may be returned to the initial position by a spring (not shown) or the like.

The drive roll 34 is then set in rotation to resume the feeding of the fastener chain 20 forwardly along the path. The foregoing cycle of operation is thereafter repeated to attach top stops 32 to the trailing ends of the successive spaced pairs of scoop groups 23.

Figure 13:
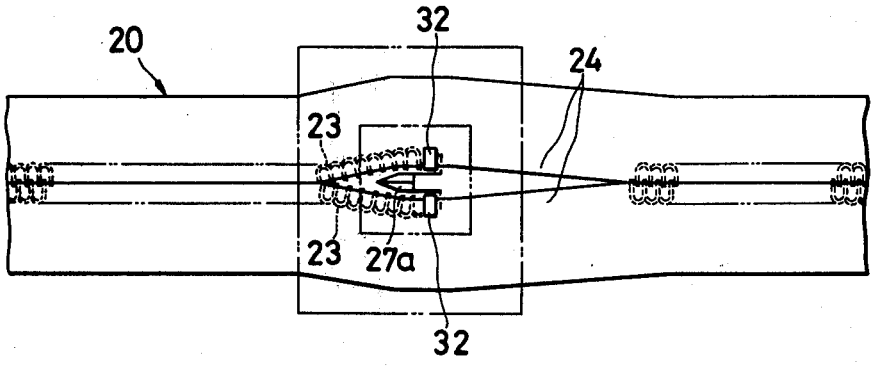
FIG. 13 is a view similar to FIG. 4 except that the pair of top stops are shown attached to the leading ends, instead of to the trailing ends, of each pair of opposed groups of scoops.
Figure 15:
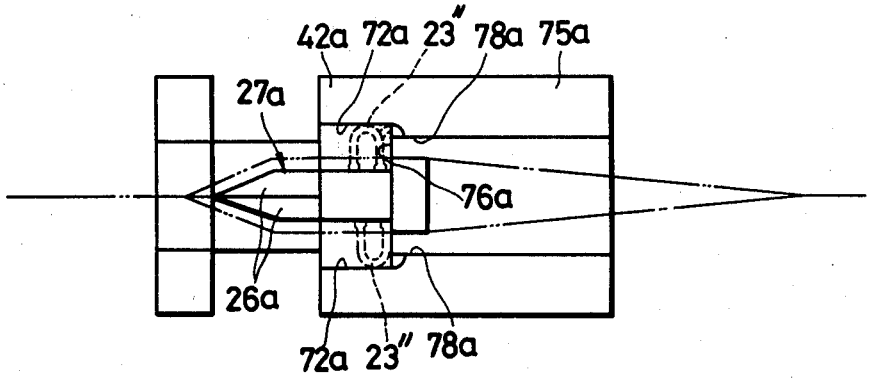
FIG. 15 appearing with FIG. 13, is an enlarged top plan view of the stop, die, and part of the separator mechanism in the apparatus of FIG. 14, wherein the chain-dot line represents the fastener stringers being separated.
Figure 14:
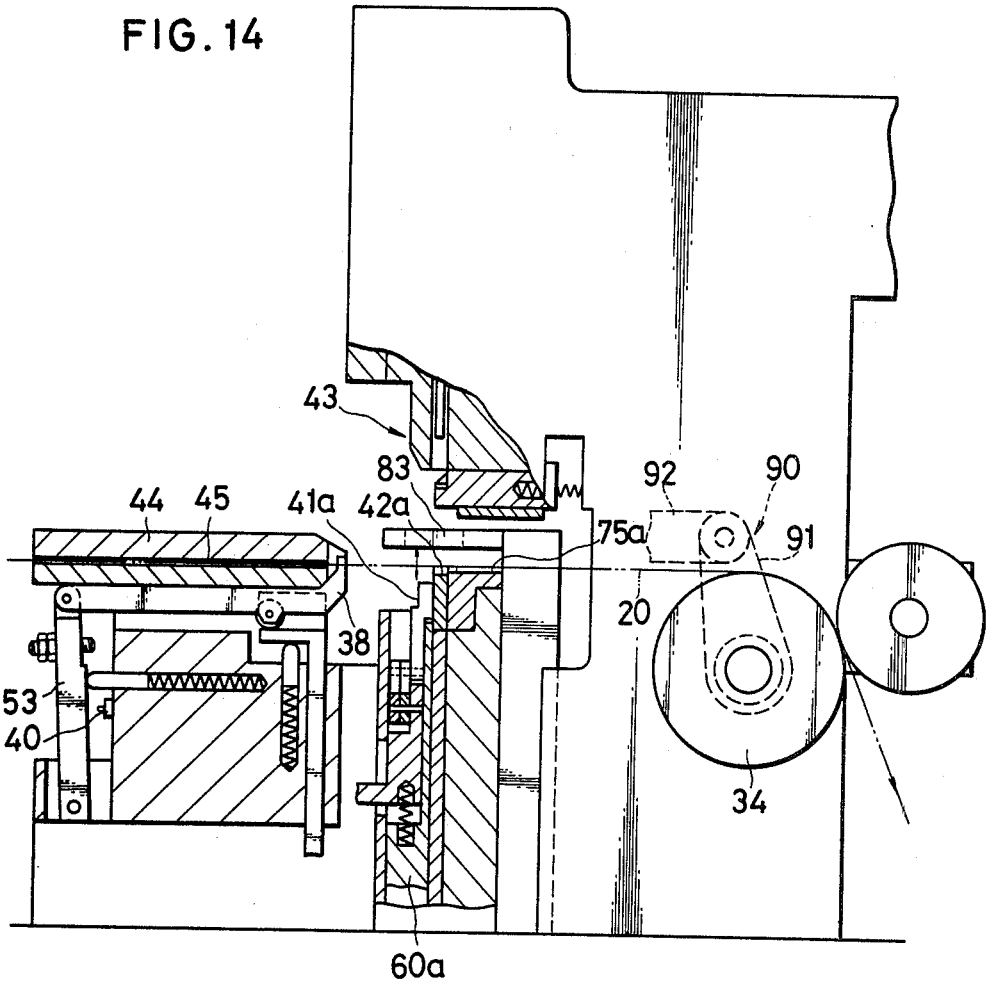
FIG. 14 is a side elevational view, partly sectioned for clarity, of another preferred form of the apparatus in accordance with the invention, the apparatus being shown adapted for attaching top stops to the leading ends of each pair of opposed scoop groups of the fastener chain as in FIG. 13.

In another preferred embodiment shown in FIGS. 13, 14 and 15, the invention is adapted for applying top stops 32 to the scoops 23'' at the leading end of each of the successive spaced pairs of scoop groups 23 of the fastener chain 20. In the apparatus shown in FIG. 14, the guide block 44, the actuating pawl 38 and other means directly associated therewith can be exactly identical in construction and relative arrangement with those in the FIG. 7 apparatus.

The FIG. 14 apparatus differs from that of FIG. 7 principally in the relative arrangement of a separator mechanism **41*a*, a die 42*a* and a stop 75*a*, and in an intermittent forward feed mechanism 90 provided to the drive roll 34 instead of the reverse feed mechanism 80 of the preceding embodiment. The separator mechanism 41*a* is disposed rearwardly of the die 42*a*, which die in turn is disposed rearwardly of the stop 75*a***.

Considered individually, the separator mechanism **41*a*, the die 42*a* and the stop 75*a* are also identical in construction with their respective counterparts of the FIG. 7 apparatus. However, each of these components is reversed in direction. Thus, for example, the separator finger 27*a* tapers both upwardly and rearwardly, and the abutment 76*a* is formed at the rear end of the stop 75*a*, as best shown in FIG. 15**.

The intermittent forward feed mechanism 90 comprises a lever 91 connected at one end to the drive roll 34 via an overrunning clutch (not shown), and an arm 92 pivotally connected to the other end of the lever 91. The arm 92 is further operatively connected to a suitable actuating mechanism (not shown), for thereby being thrusted rightwardly or forwardly to cause further movement of the stops drive roll 34 in a clockwise direction via the non-illustrated overrunning clutch. A separate drive mechanism (not shown) is connected to the drive roll 34 for the usual feeding of the fastener chain 20 along the predetermined path.

In the operation of the FIG. 14 apparatus, the actuating pawl 38 is spring biased to move upwardly and project through the gap between each pair of opposed blank tape spaces 24 of the fastener chain 20 emerging from the guideway 45, just as in the FIG. 7 apparatus. Engaged by the succeeding pair of interengaged scoop groups 23, the actuating pawl 38 is displaced forwardly along the path, until the limit switch 40 is actuated by the upstanding second arm 53.

Also as in the FIG. 7 apparatus, the actuation of the limit switch 40 results in the temporary termination of the fastener chain movement along the path, the disengagement of the actuating pawl 38 from the fastener chain, the spreading of the pair of opposed blank tape spaces 24 by the separator mechanism **41*a*, and the descent of the fastener chain holder plate 83. In this particular embodiment, however, the spreading of the pair of blank tape spaces 24 is effected in such a way that the succeeding pair of scoop groups 23 are partly disengaged from each other, as shown in FIG. 13. The separator finger halves 26*a*** are then moved back into contact with each other.

The intermittent forward feed mechanism 90 is then actuated, either after a given time interval has elapsed following the actuation of the limit switch 40 or in response to the operation of the separator mechanism **41*a*. With the drive roll 34 rotated by this intermittent forward feed mechanism 90 in the clockwise direction through a limited angle, the fastener chain 20 is fed forwardly until the leading endmost scoops 23'' of the partly disengaged pair of scoop groups move into engagement with the abutment 76*a* of the stop 75*a* and become thus properly positioned in the die cavities 72*a*. This condition is pictured in FIG. 15. Those portions of the core cords 25 of the fastener chain 20 which immediately precede the endmost scoops 23'' are now received in the grooves 78*a* in the stop 75*a*. The endmost scoops 23'' are guided by the separator finger and bell cranks of the separator mechanism 41***a* in their movement into the die cavities 72*a*.

The punch mechanism 43 is then actuated to apply the top stops 32 to the endmost scoops 23″ in the die cavities 72*a*, as shown in FIG. 13. The punch mechanism 43 and fastener chain holder plate 83 are then raised to their initial positions. The hollow guide structure 60*a* of the separator mechanism 41*a* is also raised to an extent necessary to eject from the die cavities 72*a* the endmost scoops 23″ together with the top stops 32 thereon. The guide structure 60*a* is then lowered to the initial position. Thereafter, with the drive roll 34 set in rotation to resume the feeding of the fastener chain 20, the foregoing cycle of operation is repeated to apply top stops 32 to the leading ends of the successive spaced pairs of scoop groups 23.

Supplementing the foregoing, the method includes the steps of feeding the fastener chain 20 along the predetermined path; causing the actuating pawl 38 to pass between each pair of opposed blank tape spaces 24 of the fastener chain so as to be engaged by the succeeding pair of interengaged scoop groups 23; causing the separator mechanism 41 or 41*a* to spread the pair of blank tape spaces in response to the signal generated by the limit switch 40 upon displacement of the actuating pawl with the fastener chain over the predetermined distance along the path, the pair of blank tape spaces being spread to such an extent that at least the preceding or succeeding pair of scoop groups are partly disengaged from each other; further moving the fastener chain along the path, either forwardly or rearwardly, to such an extent that the disengaged endmost scoops 23′ or 23″ of the partly disengaged pair of scoop groups come into abutment against the stop means 75 or 75*a* disposed adjacent to the die 42 or 42*a*, thereby positioning the disengaged end portions of the partly disengaged pair of scoop groups upon the die; attaching the top stops 32 to the disengaged end portions of the pair of scoop groups by the punch mechanism 43 coacting with the die; and repeating the foregoing steps to apply the top stops to the trailing or leading end portions of the successive spaced pairs of scoop groups.

Although this invention has been shown and described in very specific aspects thereof, it is to be understood that the invention is not limited to the exact details of this disclosure and that various changes and modifications may be effected therein without departing from the spirit or scope of the invention as expressed in the appended claims.

What is claimed is:

1. A method of attaching top stops to a slide fastener chain including a pair of continuous stringers, each stringer having successive spaced groups of scoops mounted on a continuous stringer tape and interengaged with opposed complementary groups of scoops on the other stringer tape, which method comprises:

(a) feeding the fastener chain longitudinally along a predetermined path;

(b) causing a displaceable actuating pawl to be engaged by one of the successive spaced pairs of scoop groups of the fastener chain so as to be displaced therewith along the path;

(c) causing a separator to spread one of the successive pairs of opposed blank tape spaces of the fastener chain in response to a signal generated upon displacement of the actuating pawl over a predetermined distance with the fastener chain, the pair of blank tape spaces being spread to such an extent that end portions of an adjacent pair of scoop groups are disengaged from each other;

(d) further moving the fastener chain along the path until the disengaged endmost scoops of the partly disengaged pair of scoop groups come into abutment against stop means disposed adjacent to a die, whereby the disengaged end portions of the partly disengaged pair of scoop groups are positioned upon the die;

(e) attaching top stops to the disengaged end portions of the partly disengaged pair of scoop groups by punch means coacting with the die; and (f) repeating the foregoing steps to apply top stops to the end portions of the successive spaced pairs of scoop groups.

2. A method of attaching top stops to a slide fastener chain including a pair of continuous stringers, each stringer having successive spaced groups of scoops mounted on a continuous stringer tape and interengaged with opposed complementary groups of scoops on the other stringer tape, which method comprises:

(a) moving the fastener chain longitudinally in a predetermined direction;

(b) causing a displaceable actuating pawl to be engaged by one of the successive spaced pairs of scoop groups of the fastener chain and hence to be displaced therewith in the predetermined direction;

(c) terminating the movement of the fastener chain when the actuating pawl is displaced a predetermined distance with the fastener chain;

(d) causing a separator to spread one of the successive pairs of opposed blank tape spaces of the fastener chain in response to the displacement of the actuating pawl over the predetermined distance, the pair of blank tape spaces being spread to such an extent that end portions of the preceding pair of scoop groups are disengaged from each other;

(e) moving the fastener chain in a direction opposite to said predetermined direction until the disengaged endmost scoops of said preceding pair of scoop groups come into abutment against stop means disposed adjacent to a die, whereby the disengaged end portions of said preceding pair of scoop groups are positioned upon the die;

(f) attaching top stops to the disengaged end portions of said preceding pair of scoop groups by punch means coacting with the die; and (g) repeating the foregoing steps to apply top stops to the trailing end portions of the successive spaced pairs of scoop groups.

3. A method of attaching top stops to a slide fastener chain including a pair of continuous stringers, each stringer having successive spaced groups of scoops mounted on a continuous stringer tape and interengaged with opposed complementary groups of scoops on the other stringer tape, which method comprises:

(a) moving the fastener chain longitudinally in a predetermined direction;

(b) causing a displaceable actuating pawl to be engaged by one of the successive spaced pairs of scoop groups of the fastener chain and hence to be displaced therewith in said predetermined direction;

(c) stopping the fastener chain when the actuating pawl is displaced a predetermined distance with the fastener chain;

(d) causing a separator to spread one of the successive pairs of opposed blank tape spaces of the fastener chain in response to the displacement of the actuating pawl over the predetermined distance, the pair of blank tape spaces being spread to such an extent that end portions of the succeeding pair of scoop groups are disengaged from each other;

(e) moving the fastener chain in said predetermined direction until the disengaged endmost scoops of said succeeding pair of scoop groups come into abutment against stop means disposed adjacent to a die, whereby the disengaged end portions of said succeeding pair of scoop groups are positioned upon the die;

(f) attaching top stops to the disengaged end portions of said succeeding pair of scoop groups by punch means coacting with the die; and (g) repeating the foregoing steps to apply top stops to the leading end portions of the successive spaced pairs of scoop groups.

4. Apparatus for attaching top stops to a slide fastener chain including a pair of continuous stringers, each stringer having successive spaced groups of scoops mounted on a continuous stringer tape and interengaged with opposed complementary groups of scoops on the other stringer tape, the apparatus comprising:

(a) means for feeding the fastener chain along a predetermined path;

(b) an actuating pawl disposed on the median line of the fastener chain for movement both along the path and in a plane normal to the plane of the fastener chain;

(c) means biasing the actuating pawl toward the fastener chain whereby the actuating pawl is capable of passing between each of the successive pairs of opposed blank tape spaces of the fastener chain so as to be engaged by the succeeding pair of interengaged scoop groups;

(d) switch means adapted to be actuated when the actuating pawl is displaced a predetermined distance along the path in engagement with the pair of interengaged scoop groups;

(e) separator means responsive to the actuation of the switch means for spreading one of the pairs of opposed blank tape spaces to such an extent that at least one adjacent pair of scoop groups are partly disengaged from each other;

(f) a die disposed substantially on the path of the fastener chain;

(g) stop means immovably disposed adjacent to the die, the stop means being adapted to engage and stop the disengaged endmost scoops of the partly disengaged pair of scoop groups as the fastener chain is further moved along the path after the spreading of the pair of blank tape spaces, whereby the disengaged end portions of the partly disengaged pair of scoop groups are positioned upon the die; and (h) punch means coacting with the die to attach top stops to the disengaged end portions of the partly disengaged pair of scoop groups.

5. An apparatus according to claim 4, wherein the switch means when actuated is further adapted to cause the feeding means to stop the fastener chain.

6. An apparatus according to claim 5, wherein the separator means is disposed forwardly, and the stop means rearwardly, of the die with respect to a predetermined direction in which the fastener chain is fed along the path, and wherein the apparatus further comprises means for moving the fastener chain in a direction opposite to said predetermined direction in moving the disengaged endmost scoops of the partly disengaged pair of scoop groups into abutment against the stop means.

7. An apparatus according to claim 5, wherein the separator means is disposed rearwardly, and the stop means forwardly, of the die with respect to a predetermined direction in which the fastener chain is fed along the path, and wherein the apparatus further comprises means for moving the fastener chain in said predetermined direction in moving the disengaged endmost scoops of the partly disengaged pair of scoop groups into abutment against the stop means.

8. An apparatus according to claim 4, 5, 6 or 7, wherein the fastener chain extends horizontally along the path, and wherein the apparatus further comprises:

(a) a first arm extending substantially horizontally under the path for movement therealong and having the actuating pawl formed at one end;

(b) an arm support disposed under said one end of the first arm for up and down motion therewith and urged upwardly by the biasing means, said one end of the first arm resting on the arm support by gravity and being movable thereover;

(c) a second arm disposed substantially uprightly and pivotally supported at its lower end, the second arm having its upper end connected to the other end of the first arm so as to permit the pivotal movement of the latter in the plane normal to the plane of the fastener chain, whereby the second arm is pivoted about its lower end with the movement of the first arm along the path; and (d) second biasing means acting on the second arm to bias the actuating pawl in a direction opposite to a predetermined direction in which the fastener chain is fed along the path.

9. An apparatus according to claim 8, wherein the switch means is a limit switch adapted to be actuated by the second arm.

10. An apparatus according to claim 8, further comprising a roller rotatably mounted on said one end of the first arm for rolling engagement with the arm support.

11. An apparatus according to claim 4, 5, 6 or 7, wherein the fastener chain extends horizontally along the path, and wherein the separator means comprises:

(a) a hollow guide structure disposed under the path for up and down motion relative to same;

(b) a slide slidably received within the guide structure for up and down motion relative to same;

(c) second biasing means yieldably urging the slide upwardly relative to the guide structure;

(d) a pair of bell cranks pivotally mounted on the guide structure;

(e) a pair of links each pivotally connected at one end to the slide and at the other end to one of the arms of one of the bell cranks; and (f) a separator finger having a pair of separable halves formed respectively on the other arms of the bell cranks.

12. An apparatus according to claim 11, wherein the die has formed therein a pair of cavities for receiving the disengaged end portions of the partly disengaged pair of scoop groups, and wherein the separator finger and said other arms of the bell cranks are adapted to serve as guides in moving the disengaged end portions of the partly disengaged pair of scoop groups into the die cavities.

13. A method of attaching top stops to a slide fastener chain including a pair of continuous stringers, each stringer having successive spaced groups of scoops mounted on a continuous stringer tape and interengaged with opposed complementary groups of scoops on the other stringer tape, which method comprises:

(a) moving the fastener chain longitudinally in a predetermined direction;

(b) sensing the arrival of one of the successive spaced pairs of scoop groups;

(c) in response to said arrival spreading one of the successive pairs of opposed blank tape spaces to such an extent that end portions of an adjacent pair of scoop groups become disengaged from each other;

(d) further moving the fastener chain along the path until the endmost disengaged scoops arrive at a fixed point; and (e) attaching the top stops to the disengaged end portions.

14. A method according to claim 13, including the further step of terminating the movement of the fastener chain when a predetermined amount of travel has occurred after said arrival.

15. A method according to claim 14, said spreading being so applied that the end portions of the preceding pair of scoop groups become disengaged, and said further movement being in a direction opposite to said predetermined direction, whereby the top stops are applied to trailing end portions of the pairs of scoop groups.

16. A method according to claim 13 or 14, said spreading being so applied that the end portions of the succeeding pair of scoop groups become disengaged, and said further movement being in said predetermined direction, whereby the top stops are applied to the leading end portions of the pairs of scoop groups.

* * * * *